US006578707B2

(12) United States Patent
Staiano

(10) Patent No.: US 6,578,707 B2
(45) Date of Patent: Jun. 17, 2003

(54) POUCH FOR SMOKING ACCESSORIES

(76) Inventor: Mark Joseph Staiano, 103 Wildwood Ct., Athens, GA (US) 30606

( * ) Notice: Subject to any disclaimer, the term of this patent is extended or adjusted under 35 U.S.C. 154(b) by 0 days.

(21) Appl. No.: 09/928,548

(22) Filed: Aug. 13, 2001

(65) Prior Publication Data

US 2003/0029745 A1 Feb. 13, 2003

(51) Int. Cl.[7] ..... B65D 69/00
(52) U.S. Cl. ..... 206/236; 206/244; 206/260
(58) Field of Search ..... 206/260, 261, 206/262, 263, 581, 478, 479, 481, 483, 823, 372, 373, 37, 38, 236, 237, 238; 150/131, 113, 147; 383/38, 39, 40

(56) References Cited

U.S. PATENT DOCUMENTS 1,722,507 A * 7/1929 Stanley ..... 206/581
1,915,007 A * 6/1933 Weiss ..... 206/581
2,014,822 A * 9/1935 Trachtenberg ..... 206/750
2,062,237 A * 11/1936 Schwartz ..... 206/581
2,167,926 A * 8/1939 Glasker ..... 206/581
2,604,919 A * 7/1952 Harwood ..... 150/131
2,623,566 A * 12/1952 Kibler ..... 190/125
2,825,208 A * 3/1958 Anderson ..... 190/109
4,555,018 A * 11/1985 Cho ..... 206/214
4,851,610 A * 7/1989 LeBlanc et al. ..... 174/35 R
4,907,634 A * 3/1990 Yoo ..... 150/135
6,041,921 A * 3/2000 Staiano et al. ..... 206/236
6,109,442 A * 8/2000 Roegner ..... 206/581

* cited by examiner

*Primary Examiner*—Shian Luong
(74) *Attorney, Agent, or Firm*—Ostrolenk, Faber, Gerb & Soffen, LLP

(57) ABSTRACT

A pouch for tobacco and smoking items and accessories includes first and second outside panels that are attached at an edge and are foldable relative to each other between an open position and a closed condition. A first pocket panel on the first outside panel and a second pocket panel on the second outside panel. A double-loop, item support attached to the second pocket panel. The double-loop is formed from a single piece of elastic material which is secured to the second pocket panel to form two different size loops and without the use of slits or other holes, for receiving the loop material, being formed in the second pocket panel.

14 Claims, 1 Drawing Sheet

POUCH FOR SMOKING ACCESSORIES

BACKGROUND OF THE INVENTION

The present invention relates to a pouch for holding smoking accessories. More particularly, the present invention relates to a foldable pouch which includes a loop arrangement within the pouch for holding smoking accessories.

U.S. Pat. No. 6,041,921 (the '921 patent) describes a foldable smoker's pouch which includes two panels which are folded over one another and enclose smoker's requirement and accessories. A band holder inside the pouch forms two loops for holding some of the smoking accessories. The first loop is formed between the two panels. The second loop is formed by extending the band through a pair of slits in one of the panels.

This loop configuration has the drawback that, when the pouch is formed from materials other than leather, the slits in a panel cause accelerated deterioration of its material. For example, if the pouch is made from a woven fabric material, the area containing the slits will fray or unravel.

SUMMARY OF THE INVENTION

Accordingly, there remains a need to provide a smoker's pouch which accommodates smoking accessories and remains structurally intact, regardless of the material used for its construction.

The present invention attempts to solve the above problems by providing a pouch for smoking accessories which incorporates smoker's articles securement loops without compromising the integrity of the material used for the pouch construction.

The pouch includes a first outside panel and a second outside panel connected at a folding section. The first and second panels are foldable relative each other between an open position and a closed position. The pouch further includes a first pocket panel inside the first outside panel and a second pocket panel inside the second outside panel. A closable storage satchel or pouch may be attached to the first pocket panel. It can hold loose tobacco, for example.

A double-loop arrangement is attached to the second pocket panel. The double-loop arrangement is preferably formed from a single loop of flexible, slightly elastic material which is secured to the second pocket panel and is shaped to define two different size loops. The double loop arrangement is attached to the second pocket panel without insertion in slits or other holes in the second pocket partition. Without slits or other holes in the material comprising the pouch, the pouch can be constructed of any desired material, including leather, canvas, vinyl, a non-woven material or the like. More significantly, the pouch, or at least its pocket panels, can be economically constructed from any natural or synthetic woven material without suffering fraying, unraveling or any similar accelerated degradation of the pouch material due to the attachment and subsequent use or manipulation of the loop arrangement.

In an alternate embodiment, a separate smoker's accessories supporting loop may be disposed on or attached to the second pocket panel.

BRIEF DESCRIPTION OF THE DRAWINGS

Other features and advantages of the present invention will become apparent from the following description of the invention which refers to the accompanying drawings, wherein.

DESCRIPTION OF A PREFERRED EMBODIMENT OF THE INVENTION

Figure 1:
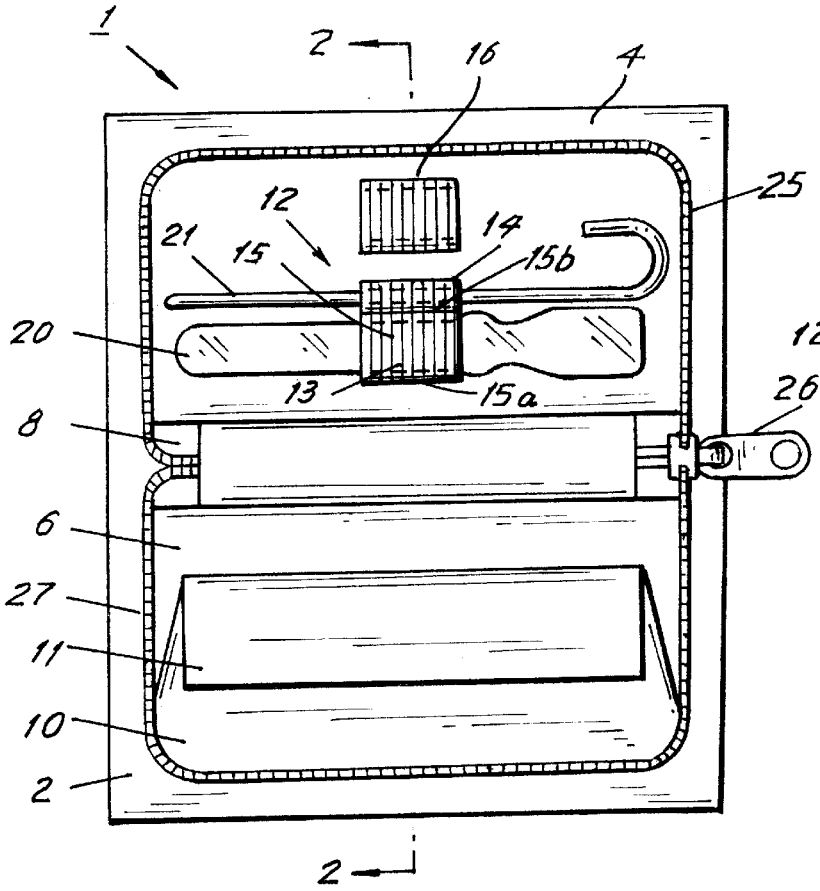
FIG. 1 shows a preferred embodiment of the pouch of the present invention in the open position.

Referring to the drawings, FIG. 1 shows a smoker's pouch 1 according to a preferred embodiment. The pouch 1 includes a first outside panel 2 and a second outside panel 4 secured to the first panel 2 at a foldable section 5. The first and second panels 2 and 4 are foldable relative to each other at section 5 between an open position shown in FIG. 1 and a closed position shown in FIG. 2.

The pouch 1 further includes a first pocket panel 6 on the inside of the first outside panel 2 and a second pocket panel 8 on the inside of the second outside panel 4.

A storage satchel or pouch 10 is attached to the first pocket panel 6. The storage pouch 10 may hold any article, like a smoking material such as loose tobacco for cigarettes or pipes. For this reason, the storage pouch is provided with a closing flap 11. The closing flap includes a securing member, such as a hook-and-loop strip, i.e., Velcro, which retains the flap closed. Other securing members include buttons, snaps or hooks.

Each of the first pocket panel 6, the second pocket panel 8 and the storage satchel 10 create pockets within the pouch 1 for the storage of smoking needs and accessories, as well as other items such as credit cards, cigarette rolling papers, money, etc. Such pockets are created between the first pocket panel 6 and the first outside panel 2; between the second pocket panel 8 and the second outside panel 4; and between the storage pouch 10 and the second pocket panel 8.

A double-loop arrangement 12 is attached to the inner side of the second pocket panel 8, i.e., the inner side when the panels 6 and 8 are folded closed. The double-loop arrangement 12 is preferably comprised of a single piece of loop forming material 15 which is secured to the second pocket panel 8 at a location along the piece of material so as to form two different size loops 13 and 14 without providing slits or other holes or cuts in the second pocket panel 8. To form the two loops 13 and 14, a first edge 15*a* of the loop material 15 is secured to the panel 8, the remaining loop material 15 is folded under and is secured at its other end to the pocket panel 8. Along the length of material, it is again attached to the panel to the panel 8 along line 15*b*, e.g. by being sewn there, to thereby define the two loops. The double-loop arrangement 12 is preferably secured by being sewn to the panel 8. As an alternative, the double-loop arrangement 12 can be secured with an adhesive. The material of the double loop is preferably elastic, to stretch for allowing insertion and removal of each smoking essential or accessory in its loop and for holding each installed item securely in place.

Each of the loops 13 and 14 is sized to be able to hold different smoking items or accessories. The larger loop 13 is of a size to hold the stem of a pipe 20, a cigarette, or the like. The smaller loop 14 is much smaller and of a size to hold a pipe poker 21. Because the poker 21 has its own specifically dimensioned loop 14, a smoker need not completely remove the poker from its loop when using it, which prevents the poker from being lost or misplaced. The poker may be partially withdrawn so that its point protrudes beyond the side edge of its panel 8, where it can be pushed into a pipe.

Because the double-loop arrangement 12 is formed without the creation of slits or other holes in the material of the panels to which it is secured, the pouch may be constructed of any desired material, including leather, canvas, vinyl or the like, and economically from any natural or synthetic woven material without danger of fraying, unraveling or any similar accelerated degradation of the pouch material due to holes used for the loops.

As shown in FIG. 1, the pouch 1 may also be provided with a separate third loop 16 attached to the second pocket panel 8 above the loop arrangement 12. Similar to the double-loop arrangement 12, the third loop 16 is preferably attached to the second pocket panel 8 without passing through slits or holes in the panel. The third loop 16 is preferably sewn to the second pocket panel 8 or, in the alternative, is secured to it with an adhesive.

In alternate embodiments, the first pocket panel 6 and/or the second pocket panel 8 can be omitted from the pouch 1. If the first pocket panel 6 is omitted, then the storage pouch 10 may be attached to the first outside panel 2 or the pouch 10 may be omitted also. If the second pocket panel 8 is omitted, the above described double-loop arrangement 12 can be secured directly to the second outer panel 4 in the same manner as described above.

Figure 2:
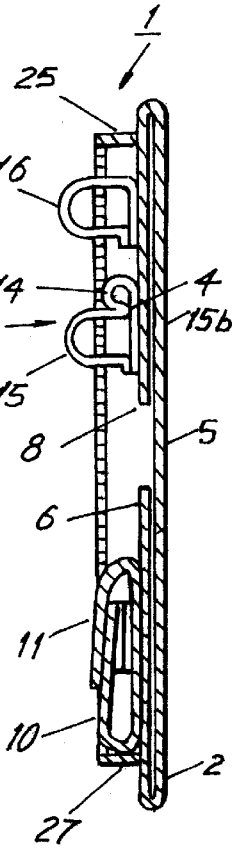
FIG. 2 is a side cross-section on 2–2 in FIG. 1.
Figure 3:
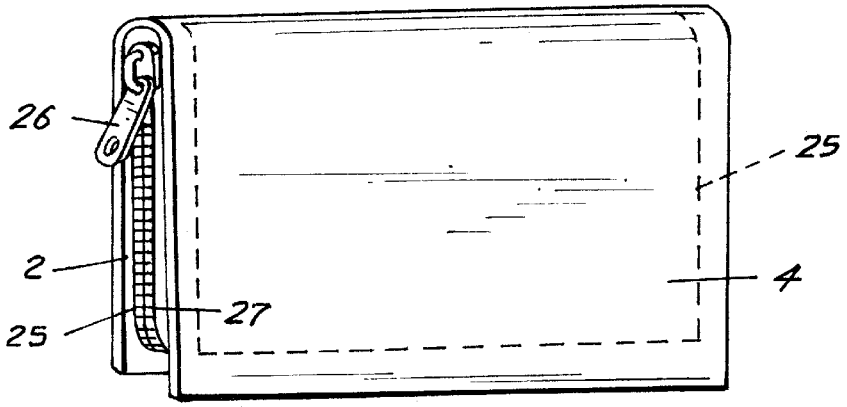
FIG. 3 shows the pouch of FIG. 1 in the closed position.

The first and second panels 2 and 4 are provided with a closure 25, which retains the pouch 1 in the closed position shown in FIG. 2. The closure 25 may be a zipper around the periphery of each of the outside panels 2 and 4. When the first and second panels 2 and 4 are folded to each other, the zipper pull 26 can close the zipper and close the pouch 1. Other closures, such as Velcro, buttons, snaps or straps may be substituted.

The closed pouch 1 may be compact to enable it to be easily and unobtrusively placed in a clothing pocket. For example, closed pouch 1 can measure from 1 to 4 inches in height, from 2 to 8 inches in length, and less than 2 inches in thickness.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A pouch for smoking items and accessories comprising:

a first panel with a foldable edge;

a second panel with a foldable edge and the second panel being secured to the first panel at the foldable edges; the panels having inner sides which are brought together when the panels are folded together around their edges; and a double-loop arrangement formed from a single piece of material attached to the inner side of the first panel wherein the single piece of material has ends and the loops of the double loop arrangement are formed from the single piece by securing the single piece intermediate the ends thereof to the first panel.

2. The pouch of claim 1, wherein the double-loop arrangement includes two different size loops.

3. The pouch of claim 1, further comprising a third loop attached to the inner side of the panels.

4. The pouch of claim 3, wherein the third loop is attached to the first panel.

5. The pouch of claim 1, wherein the piece of material is of an elastic.

6. The pouch of claim 1, wherein the piece of material is of an elastic.

7. The pouch of claim 1, further comprising:

a first pocket panel on the first panel and defining a pocket between the panel and the first pocket panel, the first pocket panel having an inner side which is brought to the second panel when the first and second panels are folder together;

wherein the double-loop arrangement is attached to the first pocket panel.

8. The pouch of claim 7, further comprising:

a second pocket panel on the second panel; and a storage pouch attached to the second pocket panel.

9. The pouch of claim 7, further comprising a closing flap closing the storage pouch.

10. The pouch of claim 1, further comprising a closure attached to the first and second panels for retaining the pouch in a closed condition with the first and second panels folded together.

11. A pouch for smoking items and accessories comprising:

a first outside panel with a foldable edge;

a second outside panel with a foldable edge and secured to the first panel edge, the second panel being foldable relative to the first panel between an open and a closed condition;

a first pocket panel inside the first outside panel and defining a pocket between the panel and the first pocket panel, the first pocket panel having an inner side which is brought to the second panel when the first and second panels are folded together;

a second pocket panel inside the second outside panel;

a storage pouch attached to the first pocket panel; and a double-loop arrangement attached to the second pocket panel, the double-loop arrangement being formed from a single piece of material wherein the single piece of material has ends and the loops of the double loop arrangement are formed from the single piece by securing the single piece intermediate the ends thereof to the first panel.

12. The pouch for smoking accessories according to claim 11, wherein the double-loop arrangement includes two different size loops.

13. The pouch for smoking accessories according to claim 11, further comprising a separate third loop attached to the second pocket panel.

14. The pouch for smoking accessories according to claim 11, further comprising a closure attached to the first and second outside panels for retaining the pouch in the closed condition.

* * * * *